United States Patent [19]

Palmer

[11] Patent Number: 4,690,384

[45] Date of Patent: Sep. 1, 1987

[54] CHAIN LINK FENCE SYSTEM

[75] Inventor: Thomas M. Palmer, Houston, Tex.

[73] Assignee: Innovative Research and Development Co., Houston, Tex.

[21] Appl. No.: 631,062

[22] Filed: Jul. 16, 1984

[51] Int. Cl.[4] ..... B21F 27/00

[52] U.S. Cl. ..... 256/47; 256/32

[58] Field of Search ..... 256/24, 25, 32, 34, 256/35, 45, 47

[56] References Cited

U.S. PATENT DOCUMENTS

| | | | |
|---|---|---|---|
| 1,147,409 | 7/1915 | Krauczyk | 256/24 |
| 2,723,107 | 11/1955 | Parker | 256/24 |
| 2,976,021 | 3/1961 | Stefan | 256/35 X |
| 3,166,299 | 1/1965 | Chellis | 256/32 |
| 3,410,527 | 11/1968 | Uroshevich | 256/32 |
| 4,492,364 | 1/1985 | Boyanton | 256/47 |

*Primary Examiner*—Cornelius J. Husar
*Assistant Examiner*—Joseph A. Fischetti
*Attorney, Agent, or Firm*—Mosely, Neal J.

[57] ABSTRACT

A chain link fence system has end, corner, or gate posts, each comprising a tubular metal post with a series of spaced, vertically-aligned openings along at least one side thereof. A supporting cross bar extends from one post to another and has a horizontally-positioned, apertured tonguemember at each end positioned in the top side opening of the post with the apertures oriented vertically. The end links of a chain link fence are positioned in the vertically aligned openings and a retaining rod inserted downwardly through the aperture in the tongue member and through the end links of chain link fence to secure the cross bar and the chain link fence wire to the post. A cap member covers the top of the post. The chain link fence is preferably secured to intermediate line posts by a novel retaining wire tie of a heavy bendable wire having the initial shape of a shepherd's crook and self closing at the crook end when properly installed. An alternate embodiment has a plurality of retainer members which fit in and are retained by the openings in each post and have openings which receive a retaining rod to secure the ends of a chain link fence thereon.

2 Claims, 15 Drawing Figures fig.1
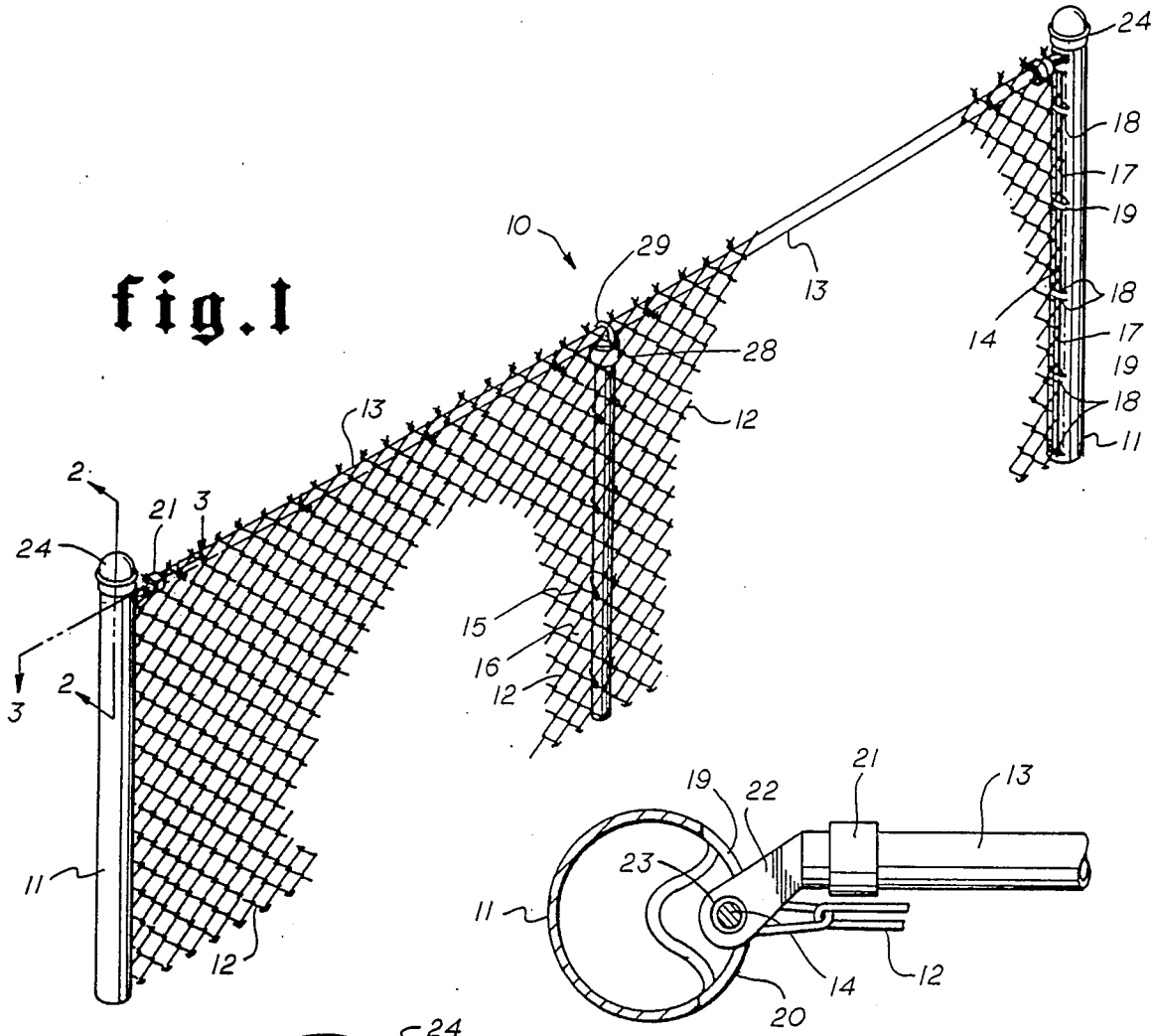
fig.3
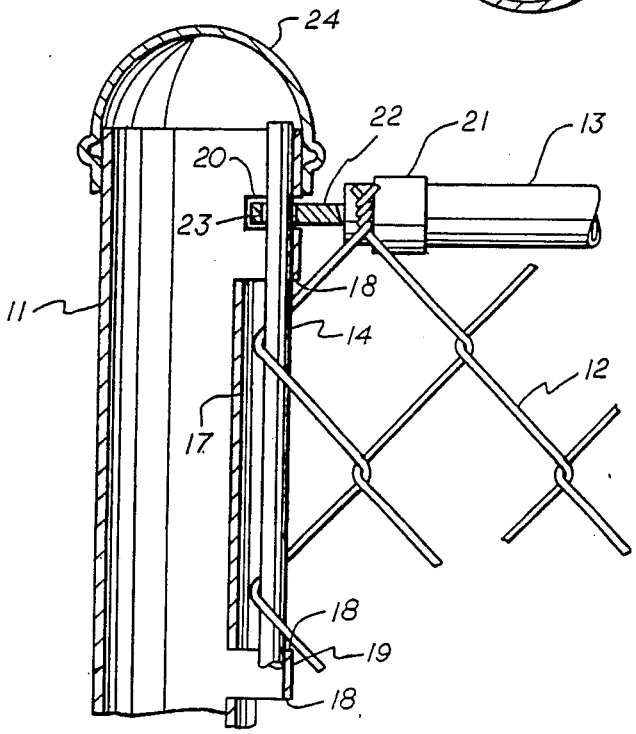
fig.2

CHAIN LINK FENCE SYSTEM

CROSS REFERENCE TO RELATED APPLICATION

This application includes some subject matter disclosed in commonly-assigned, co-pending application Ser. No. 523,838, filed Aug. 17, 1983 now U.S. Pat. No. 4,492,364.

BACKGROUND OF THE INVENTION

1. Field of the Invention

This invention relates generally to chain link metal fence systems having end, corner, or gate posts of novel construction for ease of assembly of the ends of the fence thereto.

2. Description of the Prior Art

A major cost factor in the installation of chain link fences is the time and labor required to hand assemble the many clamps and connecting hardware. The conventional chain link fence system basically comprises a section of chain link fencing material stretched and secured between two tubular fence posts. A metal rod or bar is inserted vertically through the end links ends of the fencing parallel to the post and is secured to the post by a series of strap type clamps encircling the post and the bar. A nut and bolt arrangement fastens the two ends of each clamp together. The number of clamps required depends upon the length of the post.

A cross bar comprising a section of tubing having a cap at each end is clamped between the posts near the top edge of the fence material. The cross bar end caps are provided with a flat rectangular lug having a hole for clamping to the post by straps as previously described. Wire ties are bent partially around the cross bar and each end is twisted around a strand of the fence material to secure the material to the cross bar and to intermediate posts. The process of fastening the many nuts, bolts and ties is very tedious, time consuming, and expensive. In addition, conventional posts are insecure in that they can be opened easily by disconnection of the clamps.

There are several patents which disclose other fence systems including means for easy assembly.

Engstrom, U.S. Pat. No. 751,622 discloses a fence post having a recessed area for receiving a clamping rod. The clamping rod is held in place by a plurality of eye-bolts through the eyes of which the clamping rod extends. Tightening of the nut of the eye-bolt draws the clamping rod into the recess, bending and clamping the wire runners therein.

Jones, U.S. Pat. No. 1,150,373 discloses a tubular fence post having retaining leaves struck outwardly to provide spaces between the respective retainers and the body of the tubular post. After the wires are in position, a key or holder is inserted through the spaces to hold the wire in place. The post shown is an intermediate post, not an end, corner, or gate post, for a rectangular grid wire fence. The post is not designed for use as an end, corner, or gate post and does not provide a recessed and protected connection.

Gerken, U.S. Pat. No. 1,160,709 discloses a fence post having extending hooks and tongues for receiving a tie or retaining rod. The posts are intermediate posts, not end, corner, or gate posts, and do not provide a recess to receive and protect the rod.

James, U.S. Pat. No. 1,330,809 discloses a metallic fence post (intermediate post, not an end, corner, or gate post) which has depressed or concave grooved sections between straps or bands. The straps are used to secure single strand fencing, e.g. barbed wire fencing, by hog-ring clips and are not used for chain link fencing.

Ashworth et al U.S. Pat. No. 3,370,836 discloses a chain link fence having an end, corner, or gate post or corner post with expanded strips providing apertures with the same spacing as the fence links. The end links of the fence are secured to the apertures provided by the expanded strips by a serpentine wire interconnecting the end links thereto.

Bishop, U.S. Pat. No. 3,502,303 discloses an intermediate (not an end, corner, or gate post) fence post having horizontal slots for receiving individual wires of single strand wire fencing. A locking rod or wire is vertically extended between the wires and the interior of the post to hold them in place.

Muckelrath, U.S. Pat. No. 4,058,882 discloses a metal post of angle iron or hollow square construction having holes punched along the corners thereof. The posts are intermediate posts for wire fencing comprising a plurality of separate single strands. A retaining tie wire is placed through the hole after engagement with each individual fence wire and twisted to hold the wire in place.

The prior art in general, and none of these patents in particular, disclose a chain link fence system having tubular metal end, corner, or gate posts with provision for quick connection thereon and assembly without the need for connecting a plurality of separate connecting straps.

SUMMARY OF THE INVENTION

One object of this invention to provide a chain link fence system which eliminates the need for hand assembled clamp members.

Another object of this invention is to provide a chain link fence system which is economical to manufacture.

Another object of this invention is to provide a chain link fence system which is easily and quickly installed.

Another object of this invention is to provide a chain link fence system which has improved fence wire attachment structure associated therewith.

Another object of this invention is to provide a chain link fence system which has end, corner, or gate posts providing for quick attachment of the fence cross bars and the end fence links thereto by means of a single securing rod locking the end links and end of the cross bar in slots extending through or recessed in the end, corner, or gate post or through retainers attached to said posts.

Still another object of the invention is to provide a chain link fence system having a quick assembly and release mechanism in which a plurality of retainers are positioned in slots on the fence posts to which the ends of the fence are secured.

Other objects of the invention will become apparent from time to time throughout the specification and claims as hereinafter related.

The above noted objects and other objects of the invention are accomplished by a chain link fence system having end, corner, or gate posts, each comprising a tubular metal post with a series of spaced, vertically-aligned openings along at least one side thereof. A supporting cross bar extends from one post to another and has a horizontally-positioned, apertured tongue member at each end positioned in the top side opening of the post with the apertures oriented vertically. The end links of a chain link fence are positioned in the vertically aligned openings and a retaining rod inserted downwardly through the aperture in the tongue member and through the end links of chain link fence to secure the cross bar and the chain link fence wire to the post. A cap member covers the top of the post. The chain link fence is preferably secured to intermediate line posts by a novel retaining wire tie of a heavy bendable wire having the initial shape of a shepherd's crook and self closing at the crook end when properly installed. An alternate embodiment has a plurality of retainer members which fit in and are retained by the openings in each post and have openings which receive a retaining rod to secure the ends of a chain link fence thereon.

BRIEF DESCRIPTION OF THE DRAWINGS

FIG. 1 is an isometric view of one preferred fence system having end, corner, or gate posts constructed for easy and quick connection of chain link fencing.

FIG. 2 is a vertical cross section view taken along lines 2—2 of FIG. 1 showing the quick connection of the chain link fencing.

FIG. 3 is a horizontal cross section view taken along lines 3—3 of FIG. 1.

DESCRIPTION OF A PRIOR FENCE SYSTEM

Figure 4:
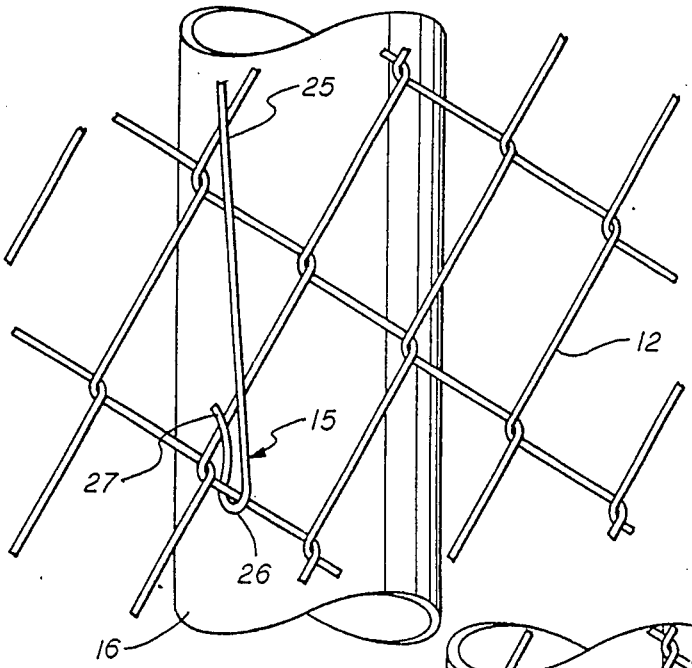
FIGS. 4, 5, and 6 are partial views, in elevation, of a portion of the fence system illustrating the sequence of attaching the fence material to a supporting post by means of a novel tie wire.

FIGS. 1-6 of this application include some subject matter disclosed in commonly-assigned, co-pending application Ser. No. 523,838, filed Aug. 17, 1983, and is set forth to illustrate the system from which the present invention was developed.

Referring to the drawings by numerals of reference, and more particularly to FIG. 1, there is shown one preferred chain link fence system 10. The fence system 10 comprises tubular metal and fence posts 11, metal chain link fence 12, a cross bar member 13, a retainer rod 14, wire tie members 15 and, depending on the length of the fence, may include one or more conventional tubular metal intermediate posts 16.

Each tubular metal end, corner, or gate post 11 has one to four vertically disposed concave grooves 17 depressed between adjacent transverse horizontal slits 18 to define a series of vertically aligned retaining bands 19. One groove is used on an end or gate post, while two, three, or four grooves are used on corner posts. The retaining bands 19 have the same curvature as the cylindrical surface of the tubular post 11.

A horizontal slot 20 is located near the top end of the post 11. The groove(s) 17 and slot 20 are formed by slitting a tubular post blank and creasing the wall of the blank to provide grooves 17 separated by retaining bands 19 and creasing the intermediate material in slot 20 inward as shown in FIGS. 2 and 3. In corner posts, two, three, or four sets of grooves 17, bands 19, and slots 20 are provided, spaced 90° apart circumferentially on the post.

Each end of the tubular cross bar member 13 is provided with an end cap 21. End caps 21 have one end of tubular shape sized to fit tightly over the ends of the tubular cross bar 13 and another end comprising an outwardly extended flat tongue portion 22 having a hole or aperture 23. An equivalent structure, such as an eye-bolt protruding from tubular cap 21 could be used.

In conventional chain link fence systems, end caps are used on cross bars, but their tongues are turned with the flat surface being vertical and the hole horizontal to the adjoining post so that a clamp may be placed on the post and its ends bolted through the hole in the tongue. In the present invention, the end caps 21 are turned with the flat surface of the tongue 22 being horizontal and the hole 23 vertical so that the tongue 22 may be inserted into the horizontal slot 20 with the tongue or eye of end cap 21 aligned with the groove(s) 17 and the retaining bands 19.

A retainer rod 14 having a length approximately the same as the length of the post 11 above the ground and its diameter sufficient to fit through the hole 23 in the tongue 22 and the space between groove(s) 17 and bands 18 is provided to secure the ends of the fence material 12 to the posts 11.

Wire tie members 15 are provided to further secure the chain link fence material 12 to the cross bars 13 and other support members, such as conventional tubular metal intermediate posts 16. The wire ties 15 are of a heavy gage bendable wire having the shape of a shepherd's crook. The wire ties 15 have one straight end 25 and which is rebent or generally J-shaped as at 26 merging into a shorter and outwardly curved leg 27 (FIG. 4). This design of tie wire is self closing when properly assembled as described below.

ASSEMBLY AND OPERATION

End, corner, or gate posts 11 are conventionally placed and set in concrete at the ends or corners of the fence line. The appropriate length of chain link fence material 12 is measured and cut with the ends forming a series of closed loops. The fencing is cut somewhat shorter than the distance between the end, corner, or gate posts 11 and is stretched tightly when installed. Cross bar members 13 are measured and cut and end caps 21 are placed on each end with the flat portion of the tongues or eyes 22 positioned to fit into the slot 20.

The tongues 22 are inserted into the slots 20 from the side. With the cross bar 13 temporarily in position, the closed or end loops of one side of the fence material 12 are placed into the groove 17 and the retainer rod 14 is inserted downwardly along the tubular post 11 in the groove 17 behind the retaining bands 19. In fencing of any substantial length, conventional tubular metal intermediate posts 16 are placed between the posts 11. These posts preferably have top caps 28 with loops 29 which receive and guide the cross bar 13.

The retainer rod 14 is passed through the hole 23 in the tongue or eye 22 of the end cap 21 and through the closed loops of the fence material 12 and comes to rest on the concrete anchor or on the earth. The top end of the retainer rod 14 should be even with or slightly below the top of the post 11. Conventional top caps 24 are placed over the top end of the post 11 to secure the retainer rod 14 in position within the post 11. The fence material 12 is then stretched to position the closed end loops or links at the opposite end of the fence in the groove 17 on the opposite end or corner post 11.

The opposite end on cross bar 13 has been placed with the tongue or eye 22 positioned in the slot 20 of the opposite end or corner post 11, as described above. Another retainer rod 14 is then passed through the hole 23 in the tongue or eye 22 and through the closed end loops of the opposite end of the fencing and come to rest on the concrete anchor or on the earth. This secures the fencing in a stretched state between the two end or corner posts 11 and abutting the intermediate posts 16.

Figure 5:
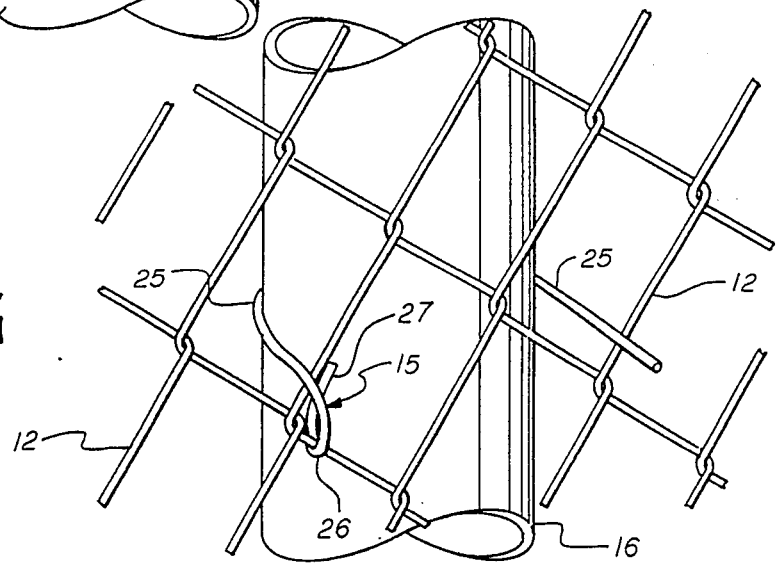
Figure 6:
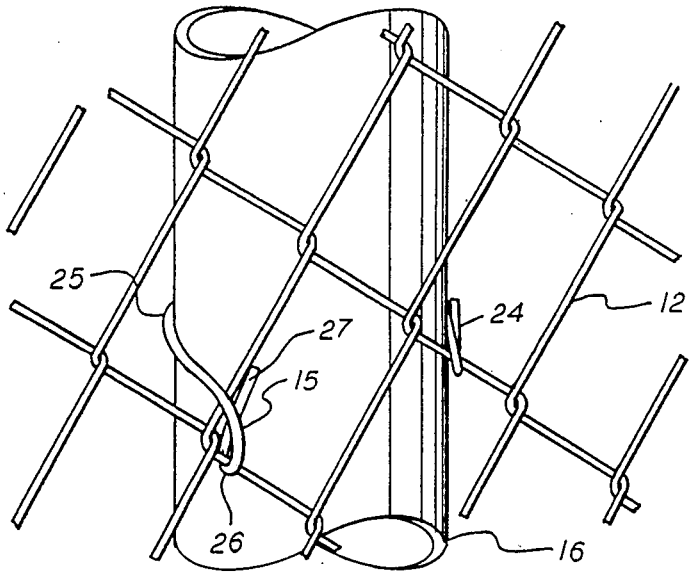

Referring now to FIGS. 4, 5, and 6, the wire ties 15 are illustrated as being used to attach the fence material 12 to an intermediate post 16 or to attach the top portion of the fence material 12 to the cross bar 13.

The J-shaped portion 26 of the wire tie 15 is inserted onto the fence material 12 at or near a point where the strands are twisted around each other. The J-shaped portion 26 of the tie wire 15 is placed onto one strand of the fence material 12 and the curved portion 27 is resting on the same strand. The long leg 25 of the tie wire 15 is bent toward the curved portion 27 as it is bent around the intermediate post 16 (or cross bar 13). This causes the J-shaped curved portion to close on itself to form a tightly closed loop (FIGS. 5 and 6).

The remaining portion of the straight leg 25 of the tie wire 15 is then bent around the cross bar 13 or post 16 until it emerges back through the fence material 12 (FIG. 5). In this position, the bending of the tie 15 has closed the J-shaped portion 26 securely around a strand of the fence material 12. The remaining portion of the straight leg 25 of the tie 15 is then twisted around a strand of the fence material nearest to the cross bar or post 16 (FIG. 6). In this matter the ties 15 are applied quickly with very little wasted motion and require only one twisting operation.

A PREFERRED EMBODIMENT

Figure 7:
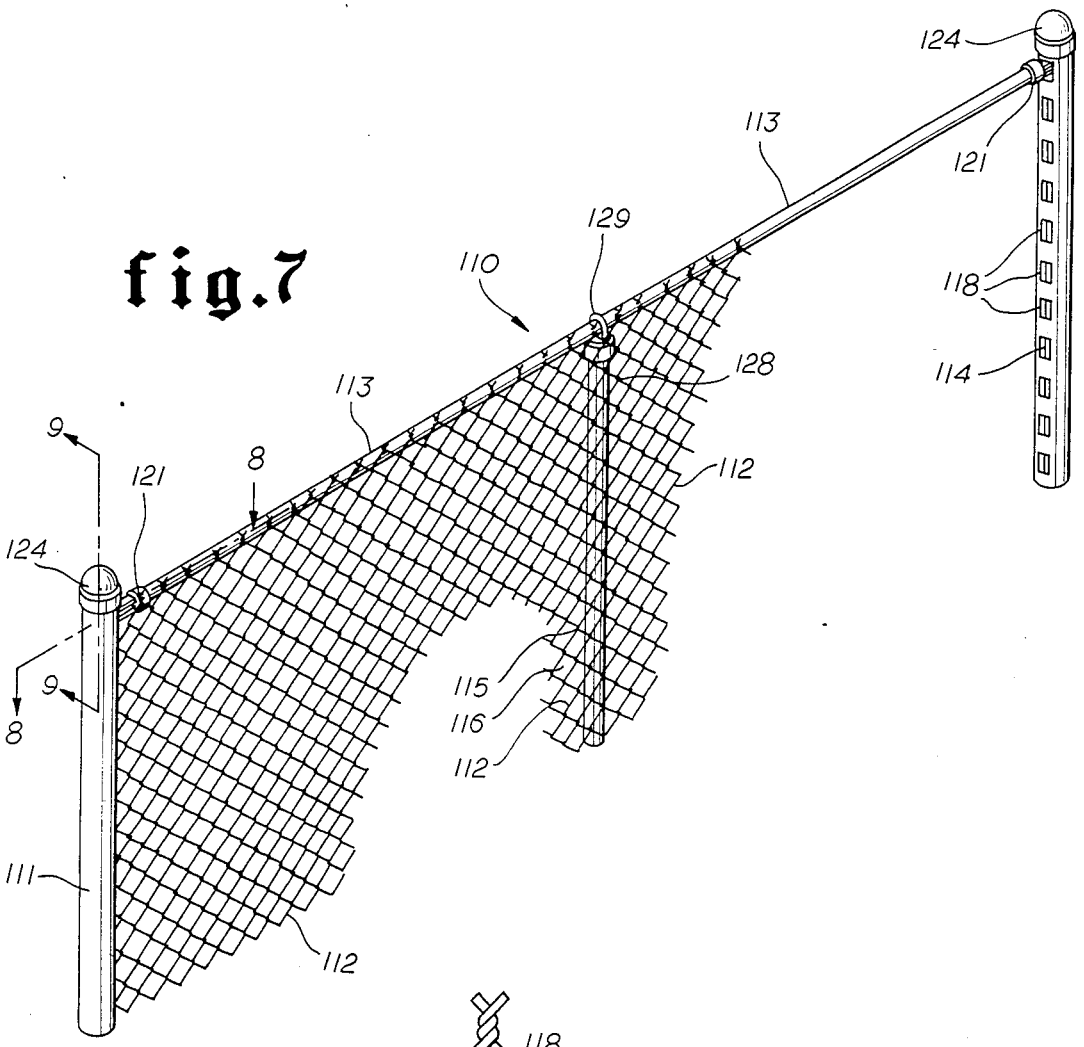
FIG. 7 is an isometric view of another preferred fence system having end, corner, or gate posts constructed for easy and quick connection of chain link fencing.
Figure 9:
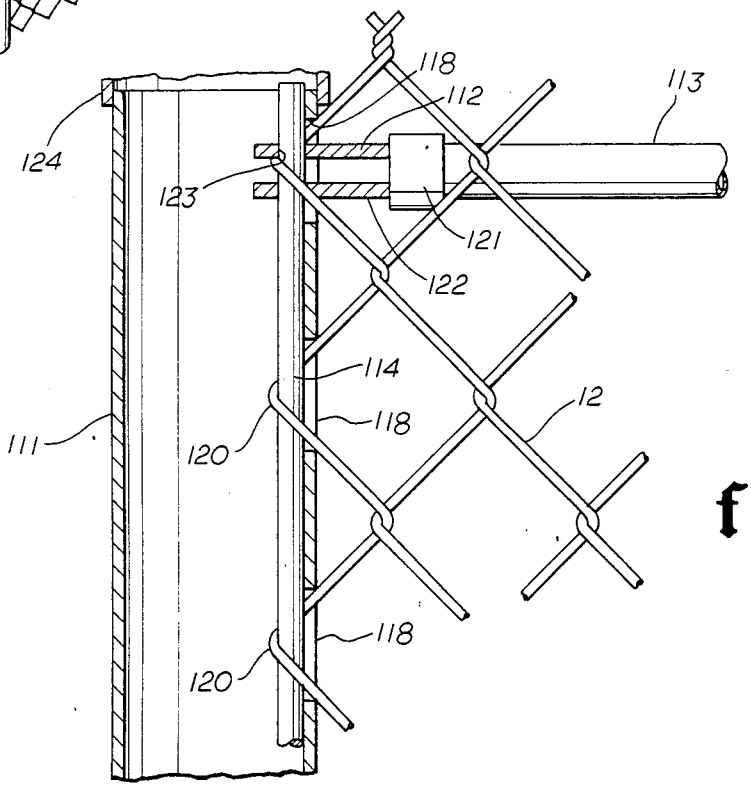
FIG. 9 is a horizontal cross section view taken along lines 9—9 of FIG. 7.
Figure 8:
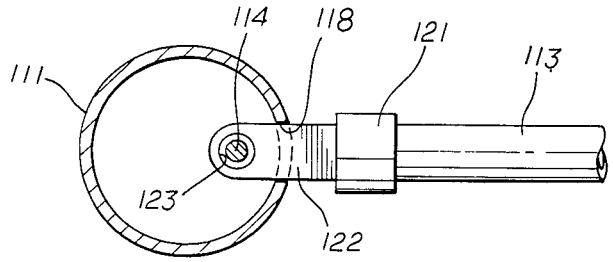
FIG. 8 is a vertical cross section view taken along lines 8—8 of FIG. 7 showing the quick connection of the chain link fencing.

In FIGS. 7–9, there is shown a preferred embodiment of a chain link fence system 110 illustrating an impvoment over the prior art. The fence system 110 comprises tubular metal end (or corner or gate) fence posts 111, metal chain link fence 112, a cross bar member 113, a retainer rod 114, wire tie members 115 and, depending on the length of the fence, may include one or more conventional tubular metal intermediate posts 116. The system is generally the same as that shown in FIGS. 1–3 but uses another embodiment of the end (or gate or corner) posts.

Each tubular metal end, corner, or gate post 111 has one to four vertically aligned series of spaced slots 118 each sized to receive at least one of the end loops 120 of the chain link fence 112. The wall of the post between the slots 118 performs the same function as the retaining bands 19 in the posts of FIGS. 1–3. One series of vertically aligned slots is used in an end or gate post, while two, three, or four series of slots are used on corner posts.

The top slot 120, located near the top end of the post 111, receive the end cap 121 of the cross bar member 113. The slots slot 120 are formed by slotting a tubular post blank to provide one to four series of vertically aligned slots 120 separated by intermediate portions of the post wall, as shown in FIGS. 7 and 9. In corner posts, two, three, or four series of vertically aligned slots 120 are provided, spaced 90° apart circumferentially on the post.

Each end of the tubular cross bar member 113 is provided with an end cap 121. End caps 121 have one end of tubular shape sized to fit tightly over the ends of the tubular cross bar 112 and the other end bifurcated to provide a pair of outwardly extended flat tongue portions 122 having aligned holes or apertures 123.

In conventional chain link fence systems, end caps are used on cross bars, but their tongues are turned with the flat surface being vertical and the hole horizontal to the adjoining post so that a clamp may be placed on the post and its ends bolted through the hole in the tongue. In the embodiment of FIGS. 1–3, the end caps are turned with the flat surface of the single tongue 22 being horizontal and the hole 23 vertical so that the tongue 22 may be inserted into the horizontal slot 20 with the tongue or eye of end cap 21 aligned with the groove(s) 17 and the retaining bands 19.

In this embodiment, the end caps are turned with the bifurcated tongues 122 being horizontal and the holes 123 vertically oriented and vertically aligned so that the bifurcated tongues 122 may be inserted into the top slot 120 with the tongues 121 aligned with the end loops 120 of chain link fence 112 when inserted in place. A retainer rod 114 having a length approximately the same as the length of the post 111 above the ground and its diameter sufficient to fit through the aligned holes 123 in the tongue 122 and the end loops 120 of the fence is provided to secure the ends of the fence 112 to the posts 111.

Wire tie members 115 are provided to secure the chain link fence 112 to cross bars 113 and other support members, such as conventional tubular metal intermediate posts 116. The wire ties 115 are of a heavy gage bendable wire having the shape of a shepherd's crook. The wire ties 115 have one straight end 125 and which is rebent or generally J-shaped as at 126 merging into a shorter and outwardly curved leg 127. This design of tie wire the same as in FIGS. 4–6 and is self closing as described above.

ASSEMBLY AND OPERATION

End, corner, or gate posts 111 are conventionally placed and set in concrete at the ends or corners of the fence line. The appropriate length of chain link fence material 112 is measured and cut with the ends forming a series of closed loops 120. The fencing is cut somewhat shorter than the distance between the end, corner, or gate posts 111 and is stretched tightly when installed. Cross bar members 113 are measured and cut and end caps 121 are placed on each end with the flat portions of the bifurcated tongues 122 positioned to fit into the uppermost slot 120.

With the cross bar 113 temporarily in position, the closed or end loops of one side of the fence material 112 are placed one in each of the slots 118 and the retainer rod 114 is inserted downwardly along the inside of tubular post 111 through each of the loops. In fencing of any substantial length, conventional tubular metal intermediate posts 116 are placed between the posts 111. These posts preferably have top caps 128 with top loops 129 which receive and guide the cross bar 113.

The retainer rod 114 is passed through the holes 123 in the tongues 122 of the end cap 121 and through the closed loops of the fence material 112 and comes to rest on the concrete anchor or on the earth. The top end of the retainer rod 114 should be even with or slightly below the top of the post 111. Conventional top caps 124 are placed over the top end of the post 111 to secure the retainer rod 114 in position within the post 111. The fence material 112 is stretched to position the closed end loops or links 120 at the opposite end of the fence 112 inside each of the slots 118 on the opposite end or corner post 111.

The opposite end cap of cross bar 113 is with the tongues 122 positioned in the uppermost slot 120 of the opposite end or corner post 111, as described above. Another retainer rod 114 is then passed through the holes 123 in the tongues 122 and through the closed end loops of the opposite end of the fencing and come to rest on the concrete anchor or on the earth. This secures the fencing in a stretched state between the two end or corner posts 111 and abutting the intermediate posts 116.

ANOTHER EMBODIMENT

Figure 10:
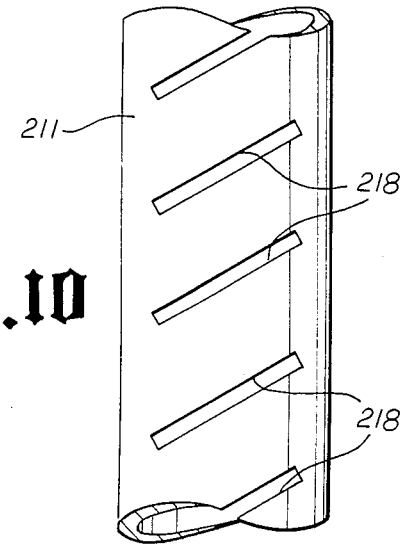
FIG. 10 is a view in elevation of another embodiment of the fence post used in this improved fence system.
Figure 11:
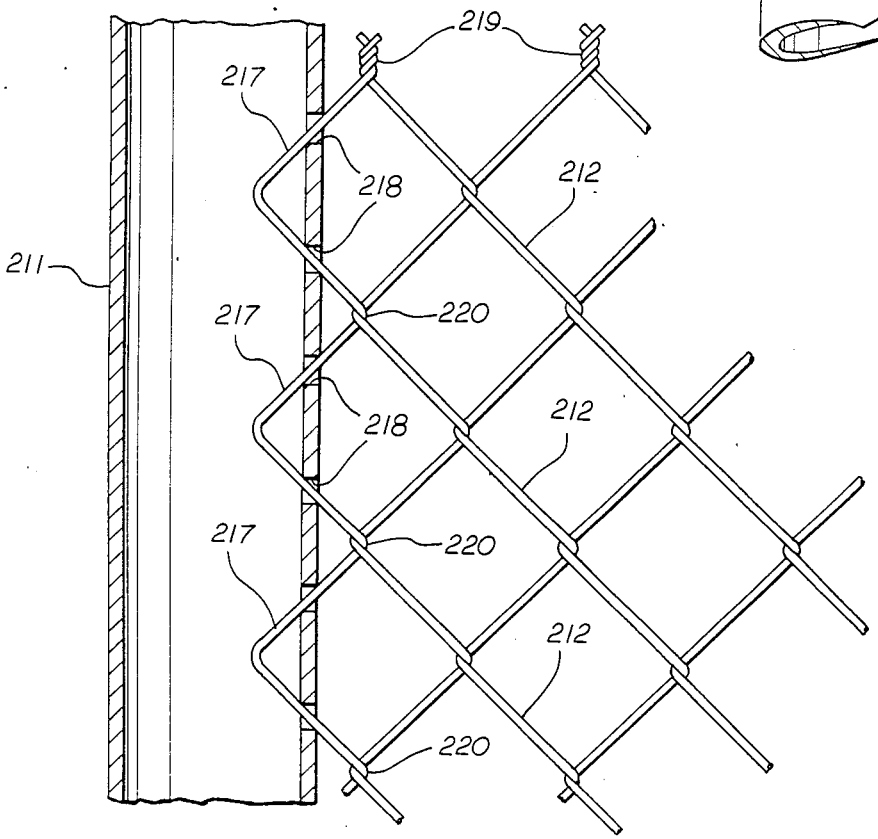
FIG. 11 is a sectional view showing the connection of a chain link fence to the fence post of FIG. 10.
Figure 12:
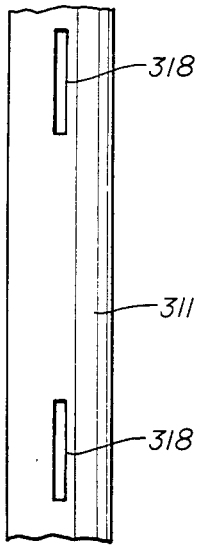
FIG. 12 is a view in elevation of still another embodiment of the fence post used in this improved fence system.
Figure 13:
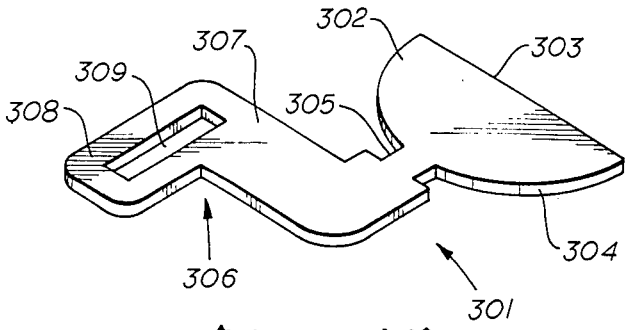
FIG. 13 is an isometric view of a retainer plate member insertable into the fence post and having slots for receiving a retainer rod for securing chain link fencing thereon.

In FIGS. 10 and 11, there is shown third embodiment of the invention. In this embodiemnt, the end (or gate or corner) posts 211 are each provided with a series of angularly disposed slots 218 which are vertically aligned thereon. On an end post or gate post there is a single series of vertically aligned, angularly disposed slots 218.

In this embodiment, a sinuous length 217 of chain link fence wire is threaded through the slots 218 and the end loops 220 of the chain link fence 212. The wire 217 is then twisted with the upper end wire of the end loop 220 to secure the same together. In this embodiment, the fence 212 is physically threaded to the end (or corner or gate) post 211 and does not require the use of the retaining rods 14 or 114. While this embodiment eliminates the need for the retaining rods 14 or 114, it is somewhat time consuming in installation.

A FURTHER EMBODIMENT

In FIGS. 12–15, there is shown still another embodiment of the invention. In this embodiment, the end (or gate or corner) posts 311 are each provided with a series of vertically-oriented slots 318 which are vertically aligned thereon. On an end post or gate post there is a single series of vertically-aligned, vertically-oriented slots 318. On a corner post or an end-to-end connecting post there are two, three, or four series of vertically-aligned, vertically-oriented slots spaced at selected locations, e.g. 90° or 180° apart, on the post.

The posts are provided with a plurality of retainer plates 301 which fit one in each of the slots 318 for securing the end of the fence in place. Retainer plate 301 (FIGS. 13–15) a semi-disc shaped retainer portion 302 having a flat edge 303 and a semi-circular rear edge 304. Retainer portion 302 is connected by a neck portion 305 to an L-shaped offset retainer portion 306. Offset portion 306 has a laterally extending portion 307 and a longitudinally extending portion 308 with a retainer slot 309 therein.

Figure 14:
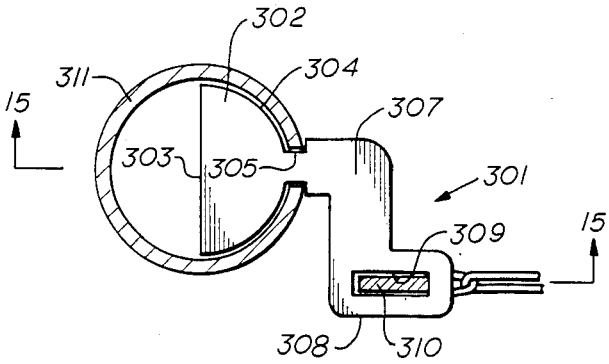
FIG. 14 is a sectional view on the line 14—14 of FIG. 15 showing the retainer plate member installed in a fence post.
Figure 15:
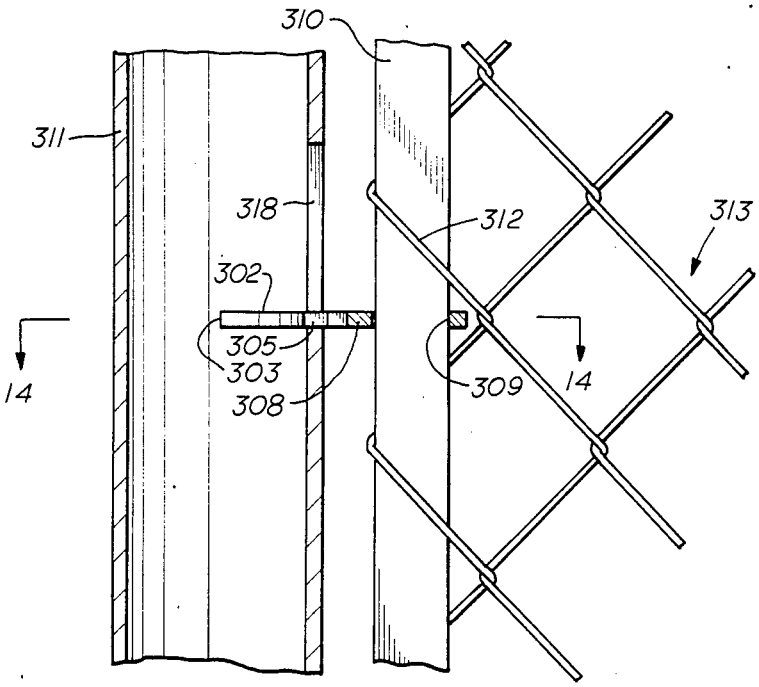
FIG. 15 is a sectional view on the line 15—15 of FIG. 14 showing the retainer plate member and the retaining rod securing a chain link fence in place.

The retainer plates 301 are positioned in slots 318 as shown in FIGS. 14 and 15. The width of flat edge 303 is of a size permitting its introduction into the post 311 through the slot 318. The retainer plate 301 is introduced through slot 318 and then twisted 90° to the position shown in FIGS. 14 and 15, the curved rear edge 304 being sized to fit the inner surface of the post 311. The slots 309 in the retainer plates 301 are therefore aligned vertically for retaining the fence in place.

To complete the installation, the end loops 312 of a chain link fence 313 are positioned adjacent to the retainer plates 301 and a retainer rod 310, of rectangular cross section, is inserted through the slots 309 and the end loops 312 to retain the end of the fence in place. The other end of the fence is then stretched to the next post and secured in place in the same manner. The end of the cross bar extending between the posts may be modified to fit the retainer rod 310 or the cross bar may be retained in the manner of the prior art.

It will be obvious to those skilled in the art that the present fence system eliminates the need for hand assembly of nuts, bolts, and clamps as used in conventional chain link fences and thus is very fast and effective and reduces the time and labor required for erection.

While this invention has been described fully and commpletely with special emphasis upon three preferred embodiments, it should be understood that within the scope of the appended claims the invention may be practiced otherwise than is specifically described herein.

I claim:

1. A chain link fence system comprising a pair of end, corner, or gate posts anchored vertically in the earth in laterally spaced relation, a cross bar extending between the upper ends of said posts and secured thereon, and a chain link fence material extending between and secured at opposite ends to said posts, in which each of said posts comprises a tubular metal post having a series of vertically aligned retaining bands spaced longitudinally thereof with narrow openings extending between said bands in vertically oriented and vertically aligned linear relation, a plurality of retainer members each comprising a flat plate having a retainer head portion having a flat edge and a semi-circular rear edge, a neck portion connected to said retainer head portion, a flat L-shaped supposting portion with a laterally extending portion extending from said neck portion and a longitudinally extending portion extending therefrom with a slot located therein, said retainer head portion being sized to fit through said post slot and said neck portion being sized to permit the same to be turned 90° in said slot with said semi-circular rear edge fitting the inner wall of said post, said retainer members being supported in said openings and extending outward therefrom and having their slots arranged in vertical orientation when installed on said posts, one of said chain link fence being positioned adjacent to said retainer members, and a retainer rod comprising an elongated rod of flat, rectangular cross section positioned in said slots and through the end loops of said chain link fence to secure the same in place, thereby securing said cross bar and chain link fence material to each of said posts.

2. A kit of materials for assembly into a chain link fence system comprising a plurality of tubular metal end, corner, or gate posts having one to four series of vertically aligned retaining bands spaced longitudinally thereof with narrow openings extending between said bands in in vertically oriented and vertically aligned linear relation, said openings being adapted to support the end loops of a length of chain link fence wire, said retaining bands lying on a common cylindrical surface with the cylndrical surface of said post, a plurality of retainer members each comprising a flat plate having a retainer head portion having a flat edge and a semi-circular rear edge, a neck portion connected to said retainer head portion, a flat L-shaped supposting portion with a laterally extending portion extending from said neck portion and a longitudinally extending portion extending therefrom with a slot located therein, said retainer head portion being sized to fit through one of said post openings and said neck portion being sized to permit the same to be turned 90° in said opening with said semi-circular rear edge fitting the inner wall of said post, said retainer members being adapted to be supported in said openings and extending outward therefrom and having their slots arranged in vertical orientation when installed on said posts, one end of said chain link fence being adapted to be positioned adjacent to said retainer members, and a retainer rod of elongated flat, rectangular cross section adapted to be positioned in said slots and through the end loops of said chain link fence to secure the same in place.

* * * * *